United States Patent [19]

Kawasaki et al.

[11] 4,027,803

[45] June 7, 1977

[54] MECHANISM FOR ASSEMBLING SHIP'S HULL

[75] Inventors: Kaoru Kawasaki; Takeshi Sakano; Shigeru Furuya, all of Kure; Shigeru Endo, Hiroshima, all of Japan

[73] Assignee: Ishikawajima-Harima Jukogyo Kabushiki Kaisha, Ote, Japan

[22] Filed: Sept. 15, 1975

[21] Appl. No.: 613,414

[30] Foreign Application Priority Data

Sept. 27, 1974 Japan ..... 49-111036

[52] U.S. Cl. ..... 214/1 H; 29/281.4; 114/65 R; 182/131; 214/1 Q; 214/130 R; 228/49

[51] Int. Cl.[2] ..... B65G 49/00

[58] Field of Search ..... 214/1 R, 1 Q, 1 H, 130 R, 214/1 QF; 228/4.1, 47, 49; 114/65 R; 29/200 P, 200 J; 182/131

[56] References Cited

UNITED STATES PATENTS

| | | | |
|---|---|---|---|
| 2,968,410 | 1/1961 | Hamilton et al. | 214/1 Q |
| 3,174,631 | 3/1965 | Swihart et al. | 214/1 Q |
| 3,620,395 | 11/1971 | Farmer, Sr. | 214/1 Q X |
| 3,670,903 | 6/1972 | Hamilton | 214/1 Q |
| 3,698,344 | 10/1972 | Maeda | 214/1 Q X |

FOREIGN PATENTS OR APPLICATIONS

| | | | |
|---|---|---|---|
| 151,976 | 1/1952 | Australia | 214/1 Q |

*Primary Examiner*—Frank E. Werner
*Attorney, Agent, or Firm*—Scrivener Parker Scrivener & Clarke

[57] ABSTRACT

A ship's hull block consisting of a skin plate, and longitudinal and transverse members fastened thereto by tack welds, is erected in the upright position so that the flat, strength welding of the joints or intersections between the longitudinal and transverse members may be carried out.

2 Claims, 16 Drawing Figures

MECHANISM FOR ASSEMBLING SHIP'S HULL

The present invention relates to a facility for assembling ship's hull blocks on the ground.

In the conventional assembly on the ground of the ship's hull blocks, the hull block is maintained in the horizontal position so that the manual fillet welding of the intersections between the longitudinal and transverse structural members welded to the skin plate may be carried out. Since the vertical welding position is employed, very high welding techniques are required as compared with the flat or downhand fillet welding process. Furthermore, the welding time is longer. Since the welding of the intersections between the longitudinal and transverse structural members occupies almost one half of the time required for assembling a hull block, the results or qualities of the welding and the welding efficiency are adversely affected by the vertical fillet welding process.

In view of the above, one of the objects of the present invention is to provide a mechanism for assembling the ship's hull blocks, wherein the easy flat welding position may be employed so that the results or qualities of the welding process may be considerably improved.

Another object of the present invention is to provide a mechanism for improving the welding efficiency and reducing the welding time in the ship's hull block assembly.

The above and other objects, features and advantages of the present invention will become more apparent from the following description of one preferred embodiment thereof taken in conjunction with the accompanying drawing in which.

Figure 2:
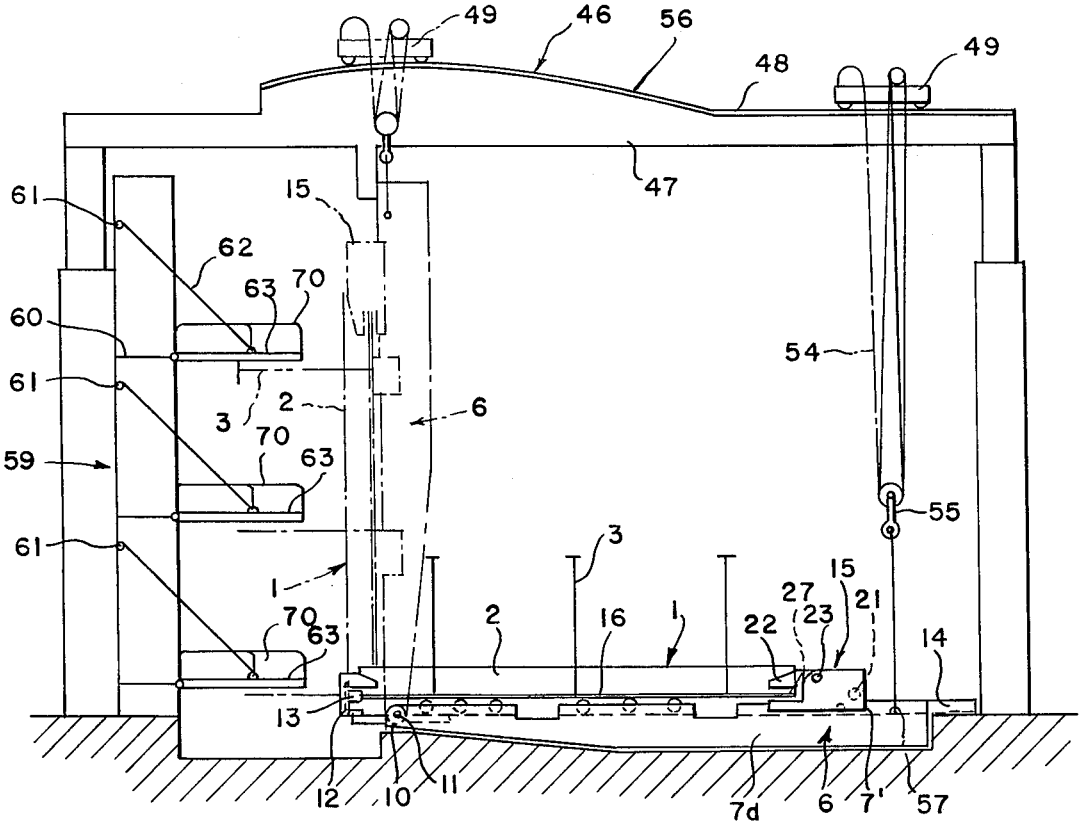
FIG. 2 is a side view thereof.
Figure 3A:
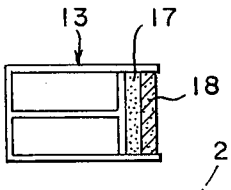
Figure 3B:
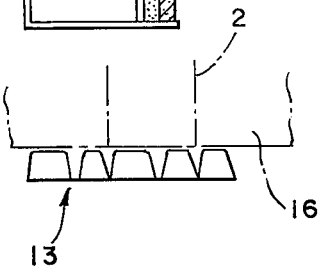
Figure 4:
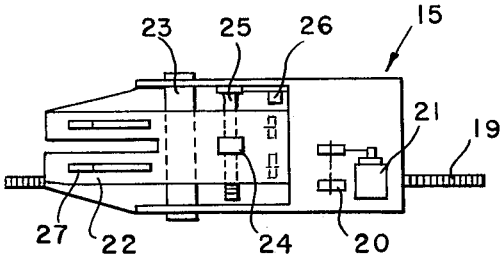
Figure 5:
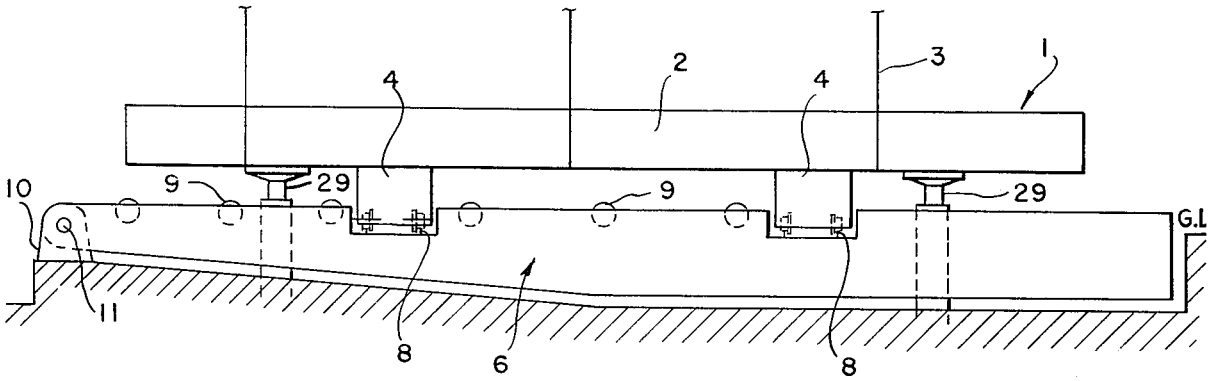
Figure 6:
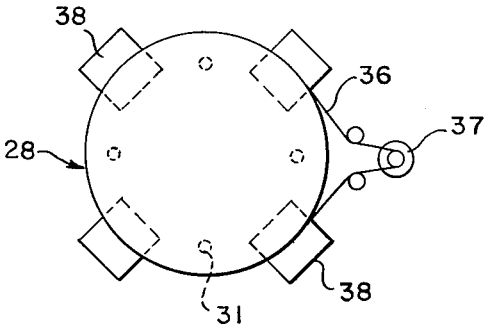
Figure 7:
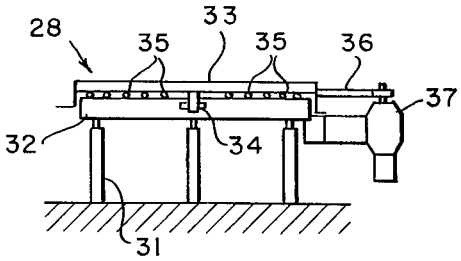
Figure 8A:
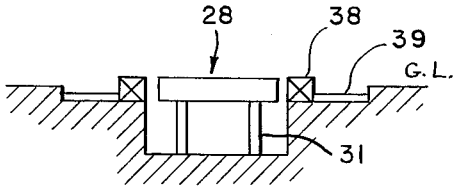
Figure 8B:
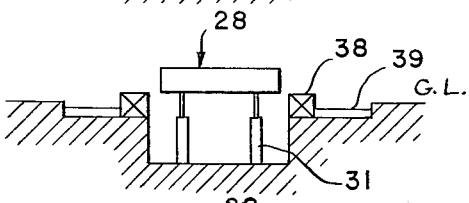
Figure 8C:
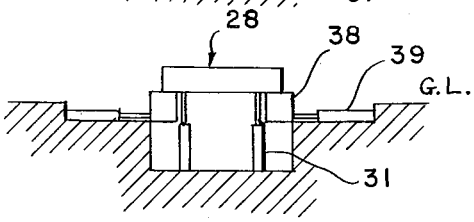
Figure 9:
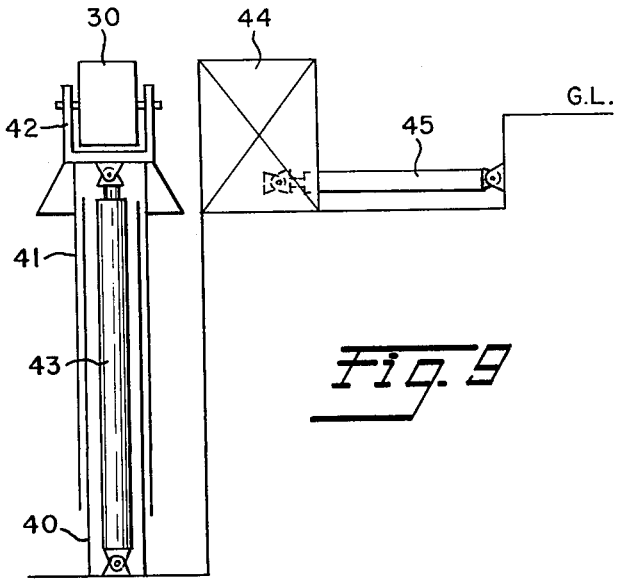
Figure 11:
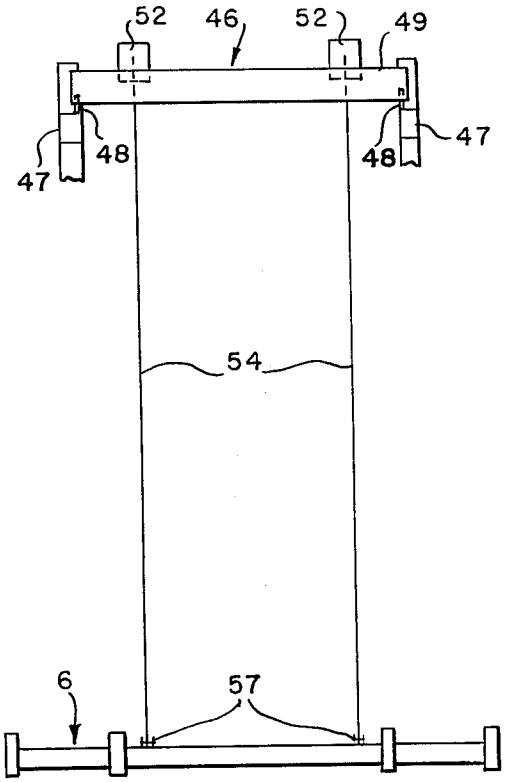
Figure 10:
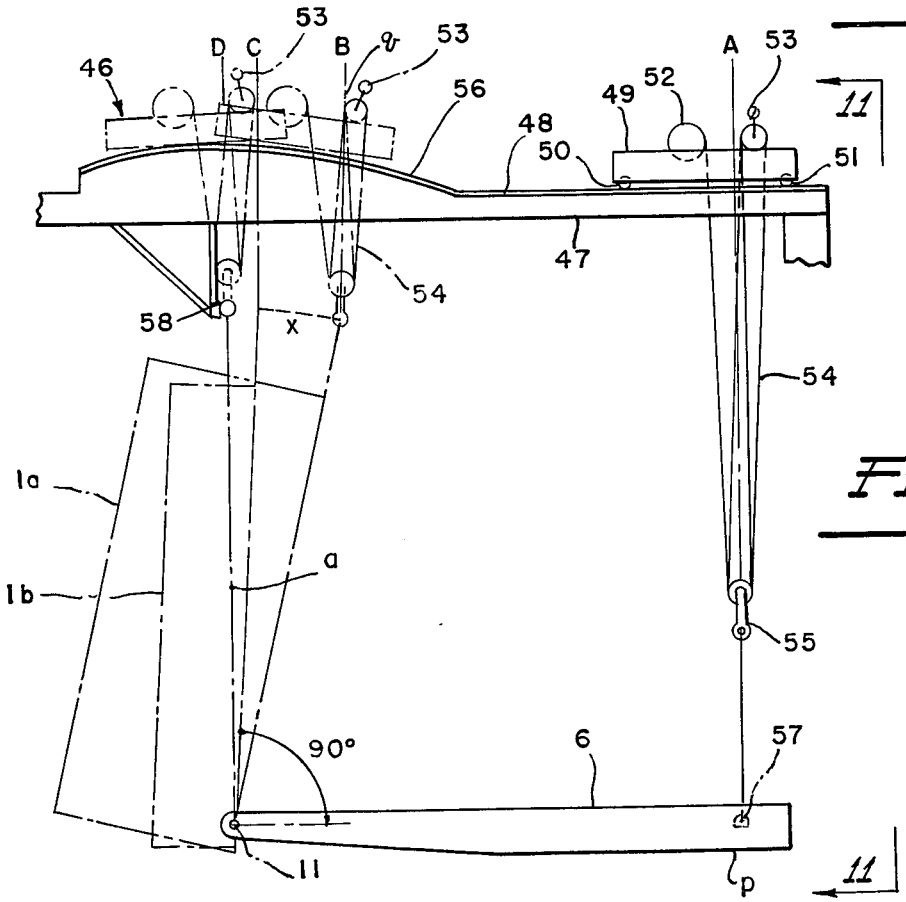
Figure 12:
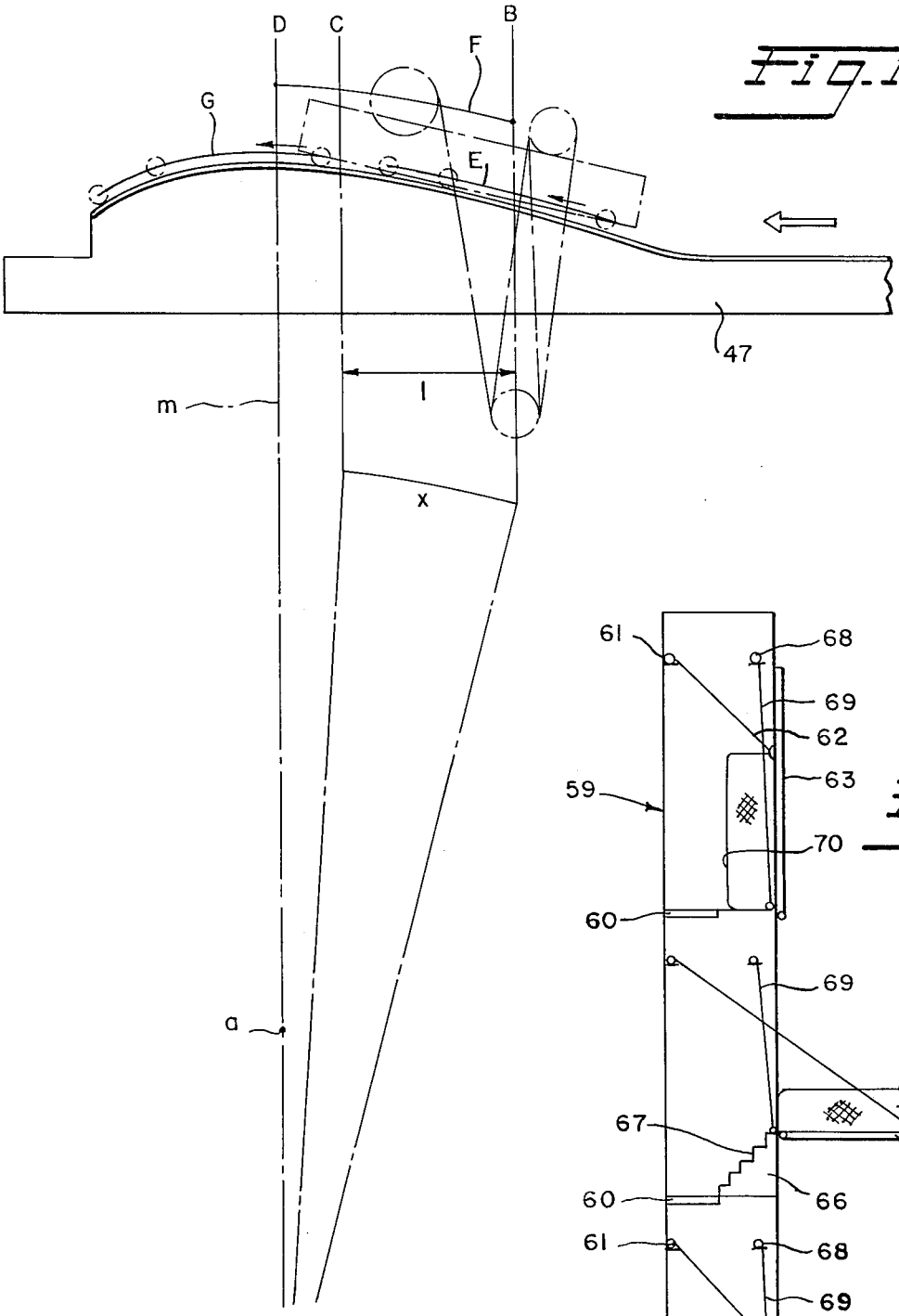
Figure 13:
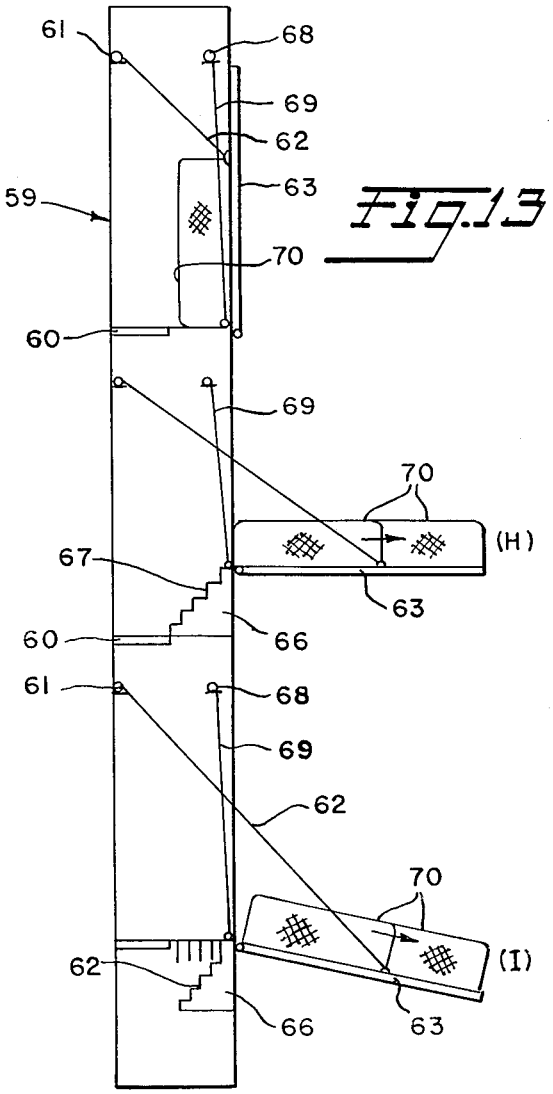

FIG. 3*a* is a sectional view of a block holder;

FIG. 3*b* is a top view of a bank of block holders;

FIG. 4 is a schematic top view of a clamping device;

FIG. 5 is a fragmentary view, on enlarged scale, of FIG. 2 illustrating a ship's hull moved into or to be moved out of the hull assembly station;

FIG. 6 is a schematic top view of a turntable;

FIG. 7 is a schematic side view thereof;

FIGS. 8*a*, 8*b* and 8*c* are views used for the explanation of the mode of operation of the turntable shown in FIGS. 6 and 7;

FIG. 9 is a schematic side view, partly in section, of an idle roller assembly which is used to support a large sized hull block when rotated;

FIG. 10 is a schematic side view of a travelling crane used for the explanation of the mode of operation thereof;

FIG. 11 is a side view thereof looking in the direction indicated by the arrows XI of FIG. 10;

FIG. 12 is a view used for the explanation of the movement of a hoist trolley over the curved sections of the girders of the travelling crane; and FIG. 13 is a schematic side view of a scaffolding installed in the hull block assembly station.

Prior to the description of the hull block assembling method in accordance with the present invention, the facility or station therefor will be described in detail hereinafter.

Figure 1:
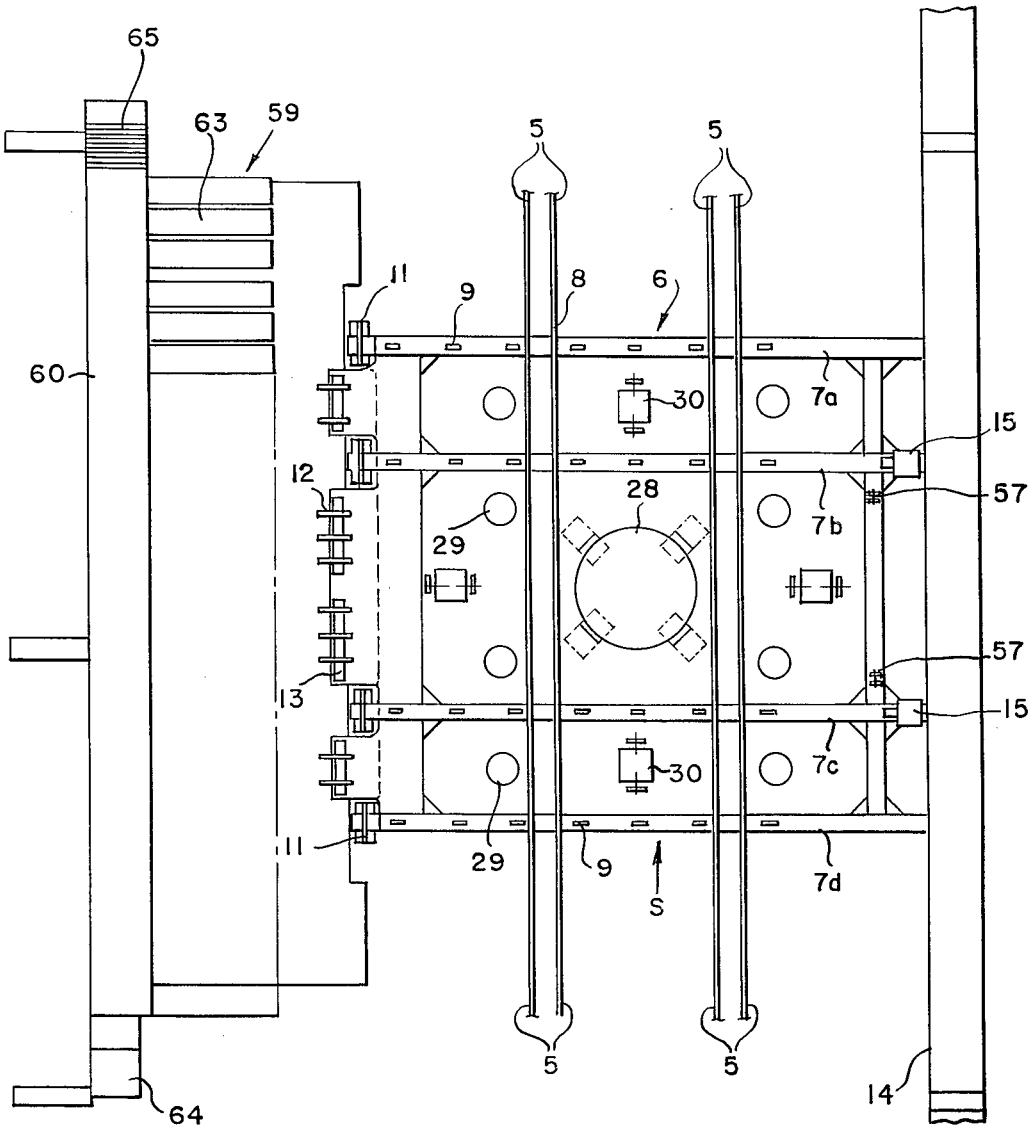
FIG. 1 is a top view of a ship's hull assembly facility or station in accordance with the present invention.

A hull subassembly 1 (See FIG. 2), which consists of a skin plate 16 to which is temporarily fastened longitudinal and transverse structural members 2 and 3 by the tack welds in the preceding subassembly station, is transported by carriages 4 (See FIG. 5), which ride on rails 5, to a block assembling or erecting station S in which is disposed a block supporting or erecting bed 6. The block erecting bed 6 has a plurality of supporting beams 7*a*, 7*b*, 7*c* and 7*d* four in the instant embodiment which are spaced apart from each other by a suitable distance and disposed at right angles relative to the rails 5 (See FIG. 1). As best shown in FIG. 5, the block erecting bed 6 has rails 8 which are securely attached to the supporting beams 7*a*–7*d* in the recesses thereof and which are in line with the rails 5 when the block erecting bed 6 is held in the horizontal position as shown in FIG. 1 so that the carriages 4 may move over the rails 8 on the block erecting bed 6 from the rails 5 laid on the foundation. One end of each of the supporting beams 7*a*–7*d* is pivoted with a pivot pin 11 to a bearing block 10 which is securely anchored to the foundation so that the block erecting bed 6 may be swung about the pivot pins 11 to be referred to as "the axis of rotation" to the upright position (indicated by the broken lines in FIG. 1) as will be described in more detail herinafter. Along one side; that is, the pivoted side of the block erecting bed 6 are attached block holding pawls 12 and block holders 13 to be described in detail hereinafter with reference to FIG. 3 in order to hold the hull block 1 when erected.

On the other side of the block erecting bed 6 and in opposed relation with the inner supporting beams 7*b* and 7*c* are disposed movable or self-propelled clamping devices 15 (See FIG. 1) which engage with guide grooves 7′ (See FIG. 2) of the supporting beams 7*b* and 7*c* so that the clamping devices 15 may move along the supporting beams 7*b* and 7*c*. In the inoperative position the clamping devices 15 are placed on the beam recess 14 which is disposed in parallel with the rail 5 and 8. When the hull block 1 is placed on disk rollers 9 of the block supporting bed 6 in a manner to be described in detail hereinafter, the clamping devices 15 move over the supporting beams 7*b* and 7*c*, push the hull block 1 until the latter engages with the block holders 13, and securely clamp the hull block 1 on the block erecting bed 6 in a manner to be described in detail hereinafter.

As shown in FIGS. 3*a* and 3*b*, each block holder 13 is provided with a cushion consisting of a rubber plate 17 and a copper plate 18 in order to receive the edge of the block, and as best shown in FIG. 3*b* the block holders 13 are spaced apart from each other in the form of a comb in order to permit the longitudinal member 2 to extend through the space between the adjacent block holders 13.

The detail of the clamping device 15 is shown in FIG. 4. The clamping device 15 has a motor 21 which drives a pinion 20 in mesh with a rack 19 laid in parallel with the upper surfaces of the beam recess 14 and the supporting beams 7*b* and 7*c* so that the clamping device 15 may move along the supporting beams 7*b* and 7*c*. A clamping pawl head 22 having hydraulically actuated clamping pawls 27 is transversely movably carried by a transverse shaft 23 and has a nut 24 in mesh with a threaded rod 25 which is rotated by a motor 26 so that the clamping pawl head 22 may move transversely along the transverse shaft 23. The clamping pawls 27 are actuated by hydraulic cylinders (not shown) so as to clamp the hull block 1 when the latter is erected.

Referring back to FIG. 1, in addition to the block erecting bed 6 and the clamping devices 15, in the block erecting station S there are provided a turntable 28 for rotating the hull block 1 through 180° for the purpose to be described hereinafter, hydraulic jacks 29 for vertically lifting the hull block 1, and a plurality of idle rollers 30.

Referring to FIGS. 6, 7 and 8, the turntable 28 comprises an under-table 32 which is supported by four hydraulic cylinders 31 anchored to the foundation so that the under-table 32 may be vertically lifted, and an upper table 33 whose center shaft 34 is inserted into the center hole of the under-table 32 may be vertically lifted, as best shown in FIG. 7. A plurality of steel balls 35 are interposed between the under-table 32 and the upper table 33 so that the latter may be freely rotated on the under-table 32. The driving chain 36 is wrapped around the upper table 33 and is drivingly coupled to the driving shaft of a motor 37 so that the upper table 33 may be rotated about the center shaft 34. When the turntable 28 is not used, it is lowered by the hydraulic cylinders 31 so that the upper table 33 is substantially in line with the ground line G.L. as shown in FIG. 8*a*.

Around the turntable 28 are disposed four supporting blocks 38 which are moved by hydraulic cylinders 39 toward the center of the turntable 28 radially thereof when the turntable 28 is in the raised position in order to support it (See FIGS. 8*b* and 8*c*).

The hydraulic jacks 29 are located as shown in FIG. 1 so that they may not interfere with the supporting beams 7*a*–7*d* of the block supporting bed 6. The hydraulic jacks 29 are actuated at the same stroke so that the hull block 1 may be lifted in the horizontal position as will be described in detail hereinafter.

The idle rollers 30 are located as shown in FIG. 1 and have the construction as shown in FIG. 9. An outer tube 41 is slidably fitted over an inner tube 40 erected vertically on the foundation, and the roller 30 is rotatably attached to a frame 42 which in turn is attached to the upper end of the outer tube 41. The lower end of a hydraulic cylinder 43 disposed within the inner tube 40 is anchored to the foundation while the upper end is fixed to the frame 42 so that the idle roller 30 may be vertically lifted by the hydraulic cylinder 43.

Still referring to FIG. 9, beside the idle roller 30 is disposed a supporting block 44 which is moved toward or away from the idle roller 30 by a hydraulic cylinder 45, and the side surface of the supporting block 44 is so shaped that it may fit over the outer tube 41. When the idle roller 30 is in the raised position, the supporting block 44 is moved toward and below the idle roller 30 so as to support the same.

Next referring to FIGS. 2, 10 and 11, a travelling crane generally indicated by the reference numeral 46 is installed in the block assembling station S in order to swing the block erecting bed 6 and hence the hull block 1 in the upright position as shown in FIG. 1. The travelling crane 46 has two girders 47 (See FIG. 11) upon which are laid rails 48 upon which travels a hoist trolley 49 with front and rear wheels 50 and 51. On the hoist trolley 49 are mounted a hoisting drum 52 and a load cell 53, and hoist wires 54 and hooks 55 are suspended from the drum 52. As best shown in FIG. 10, each girder 47 has a curved section 56 in order to prevent the abrupt rotation of the hull block 1 during the erection thereof due to the displacement of the center of gravity *a* thereof as will be described in detail hereinafter. That is, the hook 55 is joined to eye plates 57 of the block erecting bed 6, and then the hoist trolley 49 travels over the girders 47 to erect the block erecting bed 6 and hence the hull block 1. When the center of gravity *a* of the hull block 1 passes the vertical or critical line passing through the axis of the rotation of the block erecting bed 6 (that is, the pivot pins 11), the hull block will accelerate its rotation by itself even without the aid of the travelling crane 46 so that the curved section 56 is provided. The curvature of the curved section 56 is substantially similar to the locus of the center of gravity *a* of the hull block 1 when erected. A plurality of stoppers 58 are provided in order to prevent the rotation of the block erecting bed 6 in excess of 90°.

Referring back to FIG. 2, a scaffolding generally indicated by the reference numeral 59 is installed between and along the legs of the travelling crane 46 so that the welders may join the intersections between the longitudinal and transverse structural members 2 and 3 of the block 1 when the latter is erected in the upright position. The scaffolding 59 has a plurality of stationary flat-forms or working platforms 60 equal in number to the transverse members 3 of the hull block 1. A movable platform 63 is pivoted to the front side of the stationary platform 60, and is connected with a wire rope 62 to a hoisting drum 61 mounted on the scaffolding 59 so that the movable working platform 63 may swing. The scaffolding 59 is provided with an elevator 64 and a stairway 65 so that the workers ascend to the stationary platforms 60. When the hull block 1 is erected, the movable working platforms 63, which have been held in the retracted position, are extended or swung to the substantially horizontal position in line with the transverse members 3 of the erected block 1.

In order to facilitate the block assembly and improve the working conditions, the scaffolding 59 may include the welding electrode storage boxes, the power supply for welding machines, the ventilation system, the gas and oxygen supply lines, the air and water supply systems, ropes, the illumination system, and so on.

The scaffolding 59 may be arranged as shown in FIG. 13. A jig 66 with stairs 67 is suspended from a hoisting drum 68 in front of the stationary platform 60, and the movable working platform 63 is swingably attached to the jig 66. The working platform 63 with handrails 70 is extendable and retractable, and its position may be adjusted as the jig 66 is vertically displaced depending upon the level of the transverse members of the erected block 1. Therefore, the working platforms 63 may be adjusted in position even when the levels of the transverse members 3 of the block 1 are different from one block to another.

Next the mode of assembling the block 1 in the block assembling station S with the above construction will be described hereinafter. When the block subassembly 1, which is carried by the block carriages 4 traveling on the rails 5, is moved into the station S, the hydraulic jacks 29 are simultaneously actuated to lift the block 1 away from the carriages 4 as shown in FIG. 5. When the block 1 is completely lifted above the carriages 4, the latter are moved out of the block erecting station S, and then the hydraulic jacks 29 are simultaneously actuated to lower and place the block 1 upon the rollers 9 of the supporting beams 7*a*–7*d* of the block erecting bed 6. In the instant embodiment, the height of the disk rollers 9 is about 500 mm above the ground line G.L. Thereafter the clamping devices 15 are advanced from the beam recess 14 toward the supporting beams 7*b* and 7*c* and then to the block 1. In this case, the position of the clamping pawl head 22 is adjusted so that the longitudinal member 2 of the block 1 may be inserted into the space between the adjacent pawls 27. This transverse position adjustment of the clamping pawl head 22 may be accomplished by traversing the head 22 along the transverse shaft 23 by energizing the motor 26. When the clamping pawl head 22 is aligned with the longitudinal member or members 2, the clamping device 15 is further advanced along the supporting beam *7b* (*7c*) until the bottom of the space between the pawls 27 engages with the edge of the skin plate 16. Thereafter, the two clamping devices 15 are suitably advanced further until the edge of the skin plate 16 of the block 1 engages with the block holders 13 and the pawls 12. Since the copper plate 18 of the cushion of the block holder 13, which has been described in detail with reference to FIG. *3a*, is soft, it is pressed against the groove face of the skin plate 16. Since the rubber pads 17 are provided, the load is uniformly distributed over the block holder 13. Next the pawls 27 are actuated by the hydraulic cylinders or the like (not shown) so as to firmly clamp the skin plate 16 on the block erecting bed 6.

The next step is to erect the block erecting bed 6 upon which is firmly clamped the block 1 in the manner described above. For this purpose, the hoist trolley 49 is so moved upon the girders 47 that the hooks 55 of the hoist wires 54 may be removably joined to the eye plates 57 with pins on the block erecting bed 6. Thereafter, the trolley 49 is moved along the horizontal section toward the curved section 56 while the hoisting drum 52 winds the hoist wires 54 so that the block erecting bed 6 is gradually rotated about the pivot pins 11. In this case, the moving speed of the trolley 49 and the hoisting speed of the drum 52 and are so adjusted the hoisting point P; that is, the joint pin between the hook 55 and the eye plates 57 may draw a circular path or locus from 0° to 90°. More particularly, from the point A (See FIG. 10) to the point B (where the center of gravity *a* of the block 1*a*, which is the largest block to be assembled in this station S, passes the vertical line passing through the pivot pin 11; that is, the axis of rotation of the block erecting bed 6), the hoist wires 54 are lifted by the drums 52 as the trolley 49 is moved. During this lifting stage, the line connecting between the hoisting point *q* and the center of the drum 52 is always maintained vertical. At the point B, the trolley 49 is automatically stopped, and then the hoist wires 54 are further rewound until the load cell 53 detects that about two-thirds of the weight of the block 1*a* is supported by the travelling crane. Thereafter, the trolley 49 starts to travel again along the curved sections 56, and, at the point D, is automatically stopped as shown in FIGS. 10 and 12. At the point D, the upper end of the block erecting bed 6 is arrested by the stoppers 58 so that the further rotation of the bed 6 may be prevented.

If the entire length of the girders 47 is horizontal, the abrupt rotation of the block 1*a* will occur when the trolley 49 is moved as far as the point D because the center of gravity *a* of the block 1*a* passes the vertical line passing the center of rotation of the block erecting bed 6, but according to the present invention, the girders 47 are provided with the curved sections 56, and at the point B the hoist wires 54 are so wound that they may support about two-thirds of the weight of the block 1*a* so that the abrupt rotation of the block 1*a* may be prevented. Therefore, no excessive forces are imparted to the stoppers 58 and to the hoist wires 54, and the block 1*a* may be smoothly erected. In FIG. 10, the point C indicates the position at which the center of gravity *a* of the smallest block 1*b* to be assembled passes or crosses the vertical line passing the axis of rotation 11. Therefore, the center of gravity of any blocks to be assembled passes or crosses the vertical line passing the center of rotation 11 between the points B and C, and the above operation of winding the hoist wires 54 so as to support about two-thirds of the weight of the block is carried out while the trolley 49 is stopped between the points B and C.

When the hoisting point *q* passes the point C, about the half of the weight of the block 1 is supported by the pivot pins 11.

Referring to FIG. 12, E denotes the path of the rear wheel 51 of the hoist trolley 49 when the latter travels along the curved section 56; F, the path of the hoisting point *q;* G, the path of the front wheel 50; and *l*, the curvature between the points B and C; that is, the section indicated by *l* is same with that of the curve *x*. The vertical line *m* passes through the center or gravity *a* of the block 1.

Referring to FIGS. 2 and 13, when the block 1 has been erected in the upright position by the travelling crane 46 in the manner described above, the wire ropes are extended so that the working platforms 63, which have been held in the upright stored position as the uppermost working platform 63 shown in FIG. 13, are extended substantially horizontally along the transverse members 3 of the block 1. Therefore, the welders on the working platforms 63 may accomplish the flat fillet welding one side of the intersection between the longitudinal and transverse members 2 and 3. Since the welding position is flat, the welding operation may be carried out in an efficient and safeguarded manner within a short time. When the scaffolding of the type shown in FIG. 13 is used, the wire ropes are wound or unwound by the drums 68 so that the working platforms 63 may be lifted or lowered depending upon the level of the transverse members 3, and then the wire ropes 62 are extended from the drums 61 until the working platforms 63 engage with the transverse members 3 at a very small angle with respect to the horizontal line as shown at H and I in FIG. 13. Thereafter the working platforms 63 may be suitably extended or retracted depending upon the welding operations to be performed. The welders may ascend the stairs 67 to the working platforms 63.

When the fillet welding of one side of the intersection between the longitudinal and transverse members 2 and 3 of the block is accomplished, the block 1 is placed horizontally, rotated through 180° and then erected again so that the welding of the other side may be accomplished. More particularly, the hoist trolley 49 is moved back to the initial position while the hoist wires 54 are unwounded so that the block erecting bed 6 and hence the block 1 are placed in the horizontal position. Thereafter, the hooks 55 are released from the eye plates 57, and the hoist ropes 54 are wounded as shown in FIG. 2. The clamping devices 15 are driven to bring the block 1 toward the center of the erecting bed 6, and the pawls 27 are released to release the clamping devices 15 from the block 1. Thereafter the clamping devices 15 are returned to the beam recess 14.

The hydraulic jacks 29 are extended so that the block 1 may be lifted higher than when it was lifted in order to move the carriages 4 out of the erecting station S. In the instant embodiment, the block 1 is lifted about 1,550 mm above the ground line G.L. After the block 1 has been lifted, the four hydraulic cylinders 31 are actuated so that the turntable 29 may support the block 1. Thereafter the cylinders 39 of the turntable supporting blocks 38 are actuted to move the latter toward and below the turntable 28. Thereafter the hydraulic cylinders 31 are retracted so that the under table 32 of the turntable 28 may be supported by the supporting blocks 38 as shown in FIG. 8*c*. Thereafter the hydraulic jacks 29 are retracted at the same speed so that the block 1 may be placed over the turntable 28. The motor 37 is driven so that the driving chain 36 rotates the turntable 28 and hence the block 1 placed thereupon through 180° . The hydraulic jacks 29 are extended again to lift the block 1 away from the turntable 28, and then the hydraulic cylinders 39 are actuated to retract the supporting blocks 38 away from the turntable 28 as shown in FIG. 8*b*. The hydraulic cylinders 31 are actuated to lower the turntable 28 as shown in FIG. 8*a*, and then the hydraulic jacks 29 are actuated again to lower the block 1 and place it on the disk rollers 9 of the block erecting bed 6.

After the block 1 has been rotated through 180° by the turntable 28 in the manner described above, the block 1 is clamped to the block erecting bed 6 in the manner described above, and then the travelling crane raises the erecting bed 6 in the manner described above to place the block 1 in the upright position. Thereafter the working platforms 63 of the scaffolding 59 are extended in the manner described above so that the other side of the intersection between the longitudinal and transverse members 2 and 3 of the block may be welded at the flat welding position. Thus both sides of the intersection between the longitudinal and transverse members 2 and 3 are welded.

After welding, the block erecting bed 6 and hence the block 1 clamped thereupon are returned to the horizontal position in the manner described above, and the hooks 55 are released from the eye plates 57 while the clamping devices 15 are released and returned to the beam recess 14. Thereafter, the hydraulic jacks 29 are actuated again to lift the block 1 away from the disk rollers 9, and then the carriages 4 are moved below the block 1. The hydraulic jacks 29 are actuated to lower the block 1 to place it upon the block carriages 4. The carriages 4 travel along the rails 5 to transport the assembled block 1 to the next station or any other desired working area.

When the rotation through 180° of the block 1 by the turntable 28 along is not carried out in a stable manner, the idle rollers 30 are used. That is, the idle roller 30 is raised by the hydraulic cylinder 43, and then the hydraulic cylinder 45 is actuated to place the supporting block 44 below the roller 30. The hydraulic cylinder 43 is actuated again to lower the idle roller 30 to place the frame 42 upon the supporting block 44. In this position, the height from the ground level of the idle roller 30 is same with that of the turntable 28 in the raised position. Thus the rotation of the large block 1 may be carried out in a stable manner.

So far the preferred embodiment of the present invention has been described, but it will be understood that the present invention is not limited thereto and that various modifications may be effected within the true spirit of the present invention. For instance, instead of the clamping devices 15, any other suitable clamping devices may be used. When the stoppers 58 are strong enough to safely receive the impacts from the block erecting bed 6 when the latter is erected, the curved sections of the girders 47 of the travelling crane 46 may be eliminated. Furthermore when the capacity of the turntable 28 is sufficient enough to lift the block 1 the hydraulic jacks 29 may be eliminated.

As described above, according to the present invention, the welding between the longitudinal and transverse members, which occupies about one half of the block assembling works may be accomplished by the flat fillet welding not by the vertical welding. Therefore the following advantages may be attained:

i. Since the welders may accomplish the welding processed in an easy and stable position, the welding processes may be much facilitated.
ii. High welding efficiency may be attained.
iii. Time required for assembling one block may be considerably reduced.
iv. Because of the advantages above, the block assembly rate may be remarkably increased.
v. Welding conditions may be considerably improved.
vi. Since the welding conditions may be improved, the automatic welding machines may be employed in the future.
vii. Because of the flat welding position, the satisfactory weld beads may be obtained; welding defects may be considerably reduced; and the later adjustments may be reduced.
viii. The block is rotated through 180° and is erected so that welding on both sides may be accomplished. Therefore, it is not necessary to provide a large working area for assembly of the blocks. The sudden rotation due to the fact that the center of gravity of the block passes or crosses the vertical line passing the center of rotation may be prevented so that the smooth and safe erection of the block may be ensured.
ix. Since the girders of the travelling crane are provided with the curved sections, the hoist wires will not be subjected to the excessive forces and the smooth erection of the block may be ensured.

What is claimed is:

1. Mechanism for assemblying ship's hull blocks having longitudinal and transverse structural members to be welded together, said mechanism comprising a hull block supporting and erecting bed for supporting a hull block in a horizontal position, a stationary part, means forming a pivotal connection between one side edge of the bed and said stationary part, and means including a travelling crane for rotating said bed and hull block about said pivotal connection to move the bed and block to an upright position for welding operations between said structural members and to return the bed and block to a horizontal position, said crane having a substantially horizontal track terminating in an upwardly convex curved section positioned above said pivotal connection.

2. Mechanism as set forth in claim 1 further comprising a scaffolding for welding the intersections between the longitudinal and transverse structural members of the hull block when the latter is erected in the upright position.

* * * * *